US007752713B2

(12) United States Patent
Stura et al.

(10) Patent No.: US 7,752,713 B2
(45) Date of Patent: Jul. 13, 2010

(54) DEVICE FOR ELECTRICALLY POWERING ELECTRICAL MEMBERS POSITIONED ON A REFRIGERATOR DOOR

(75) Inventors: Marco Stura, Varese (IT); Monica Zibelli, Varese (IT)

(73) Assignee: Whirlpool Corporation, Benton Harbor, MI (US)

( * ) Notice: Subject to any disclaimer, the term of this patent is extended or adjusted under 35 U.S.C. 154(b) by 2043 days.

(21) Appl. No.: 09/898,962

(22) Filed: Jul. 3, 2001

(65) Prior Publication Data

US 2002/0002758 A1 Jan. 10, 2002

(30) Foreign Application Priority Data

Jul. 6, 2000 (IT) ..... MI000407 U

(51) Int. Cl.
*E05D 5/02* (2006.01)

(52) U.S. Cl. ..... 16/387; 16/386

(58) Field of Classification Search ..... 16/387, 16/386, 385, 223, 225, 368; 361/680–683, 361/687; 62/441, 531; 455/575.3; 136/245
See application file for complete search history.

(56) References Cited

U.S. PATENT DOCUMENTS

| | | | | | |
|---|---|---|---|---|---|
| 221,434 | A | * | 11/1879 | Watson | 200/61.7 |
| 531,515 | A | * | 12/1894 | Davis | 439/31 |
| 615,209 | A | * | 11/1898 | Baxter | 439/31 |
| 1,744,040 | A | * | 1/1930 | Elzer | 439/31 |
| 2,259,800 | A | * | 10/1941 | Cox | 439/777 |
| 2,648,093 | A | * | 8/1953 | Wilson | 16/370 |
| 2,674,761 | A | * | 4/1954 | Weiss | 16/288 |
| 2,715,715 | A | * | 8/1955 | Bentley | 439/733.1 |
| 2,778,000 | A | | 1/1957 | Mills | 339/4 |
| 2,895,033 | A | * | 7/1959 | Favre | 200/261 |
| 3,089,202 | A | | 5/1963 | Pulaski | 20/16 |
| 3,103,398 | A | * | 9/1963 | Phelps | 439/31 |
| 3,523,323 | A | * | 8/1970 | Jorgensen | 16/302 |
| 3,659,063 | A | * | 4/1972 | Peterson | 200/61.7 |
| 3,673,635 | A | * | 7/1972 | Cencioni | 16/358 |
| 3,715,537 | A | * | 2/1973 | Peterson | 200/61.7 |
| 3,857,625 | A | * | 12/1974 | Crane et al. | 439/31 |
| 3,937,403 | A | * | 2/1976 | Lawson | 439/424 |
| 3,955,044 | A | * | 5/1976 | Hoffman et al. | 174/84 C |
| 4,543,800 | A | * | 10/1985 | Mawby et al. | 62/339 |
| 4,671,582 | A | | 6/1987 | Stromquist et al. | 439/31 |
| 5,212,907 | A | * | 5/1993 | Van Sandt | 49/70 |

(Continued)

FOREIGN PATENT DOCUMENTS

| | | |
|---|---|---|
| FR | 2539798 | 7/1984 |

(Continued)

*Primary Examiner*—Chuck Y. Mah
(74) *Attorney, Agent, or Firm*—Kirk W. Goodwin; McGarry Bair PC

(57) ABSTRACT

A device for electrically powering electrical members or user devices positioned on a refrigerator door, the refrigerator comprising an insulated cabinet defining at least one food preservation compartment on which said door is movably disposed, at least one hinge member being provided for the connection between the cabinet and said door; with the cabinet and with the door there being associated electrical conductors connected respectively to an electrical source and to each user device positioned on the door, said conductors being electrically connected together via the hinge member, which is constructed such that at least a part of it is electrically conductive.

11 Claims, 2 Drawing Sheets

U.S. PATENT DOCUMENTS 5,237,488 A * 8/1993 Moser et al. ..... 361/681
5,267,866 A * 12/1993 Swift et al. ..... 439/31
5,497,534 A * 3/1996 Caruso ..... 16/288
5,717,380 A * 2/1998 Zehrung ..... 340/545.7
5,787,724 A 8/1998 Pohl et al. ..... 62/389
6,081,969 A * 7/2000 Tanahashi et al. ..... 16/337
6,089,881 A * 7/2000 Daoud ..... 439/92
6,320,114 B1 * 11/2001 Kuechler ..... 136/245
6,407,517 B1 * 6/2002 Hayashi et al. ..... 315/370
6,409,517 B2 * 6/2002 Malnati ..... 439/38
6,507,490 B2 * 1/2003 Sasaki et al. ..... 361/687

FOREIGN PATENT DOCUMENTS

JP 09060397 A * 3/1997
JP 2004121777 A * 4/2004

* cited by examiner

DEVICE FOR ELECTRICALLY POWERING ELECTRICAL MEMBERS POSITIONED ON A REFRIGERATOR DOOR

BACKGROUND OF THE INVENTION

1. Field of the Invention

The present invention relates to a refrigeration appliance having a compartment closed by a door which has electrically operated devices mounted thereon.

2. Description of the Related Art

A refrigerator is known to comprise a cabinet containing at least one food preservation compartment on which a closure door is positioned, connected to the cabinet by at least one hinging member, or hinge for simplicity. The term "refrigerator" means either an upright household electrical appliance comprising a compartment (refrigeration compartment) for preservation at a temperature exceeding 0° C. with a possible further compartment (freezer compartment) for preserving food at a temperature less than 0° C., or a household electrical appliance for preserving food only at a temperature less than 0° C. (for example a chest freezer). If the refrigerator comprises more than one compartment, each of them can be provided with a closure door.

A refrigerator is also known, for example from a preceding application in the name of the same Applicant, the door of which carries electrically powered appliance control members by which the user can effect this control without requiring access to the refrigerator. Other refrigerators are also known presenting electrically powered user devices on their door, such as drink or ice dispensers, operable by the user without requiring access to the appliance.

SUMMARY OF THE INVENTION

An object of the present invention is to provide a device enabling simple and correct electrical connection of said electrical members or user devices positioned on a refrigerator door, while also enabling the door mounting direction to be easily reversed.

Another object is to provide a device of the said type which is of simple construction and of safe and reliable use for the user.

These and further objects which will be apparent to the expert of the art are attained by a device in accordance with the accompanying claims.

BRIEF DESCRIPTION OF THE DRAWINGS

The invention will be more apparent from the accompanying drawing, which is provided by way of non-limiting example and in which.

DESCRIPTION OF THE PREFERRED EMBODIMENT

Figure 1:
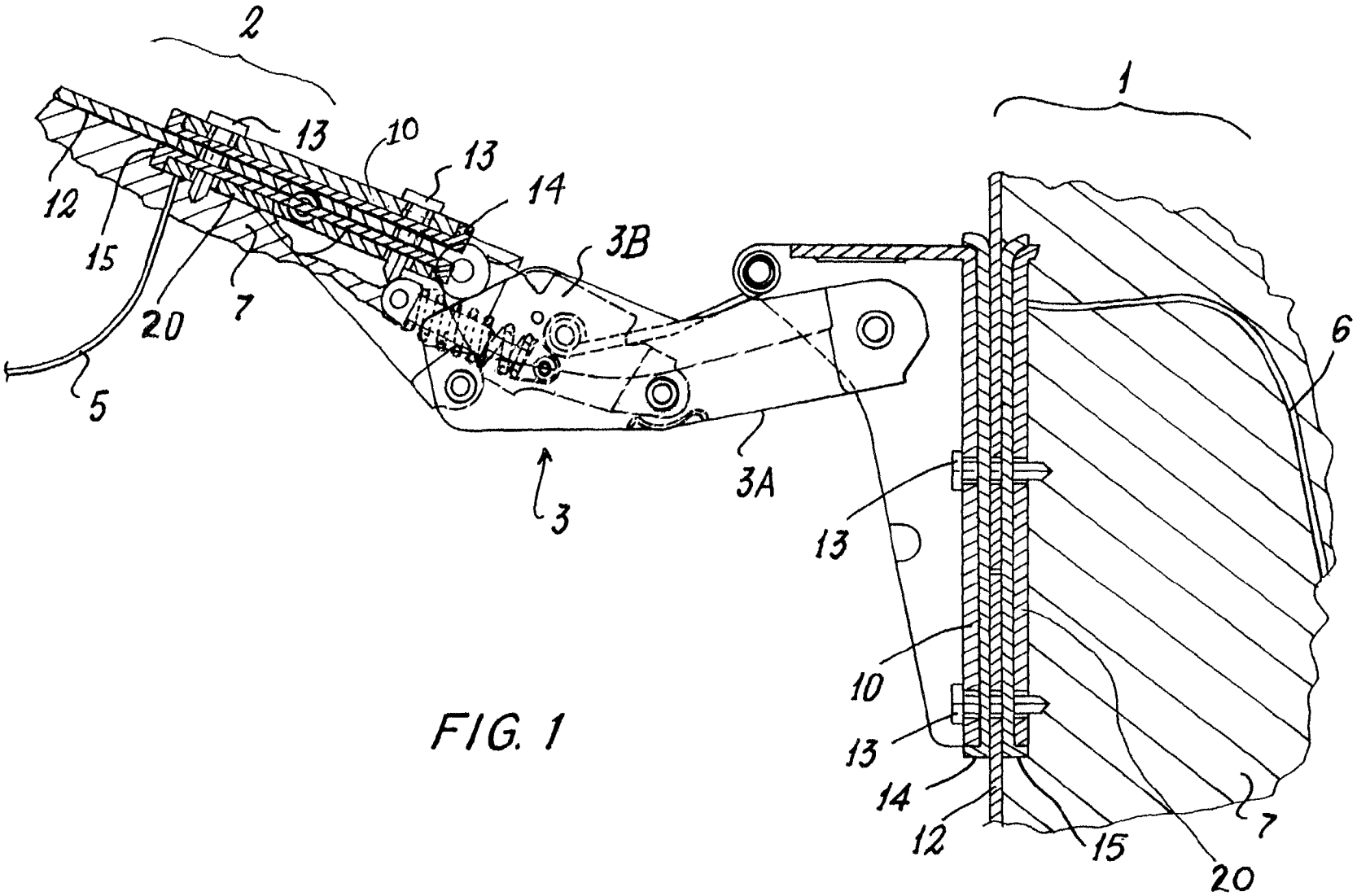
FIG. 1 is a detailed cross-section through a part of a refrigerator showing a device of the invention.
Figure 2:
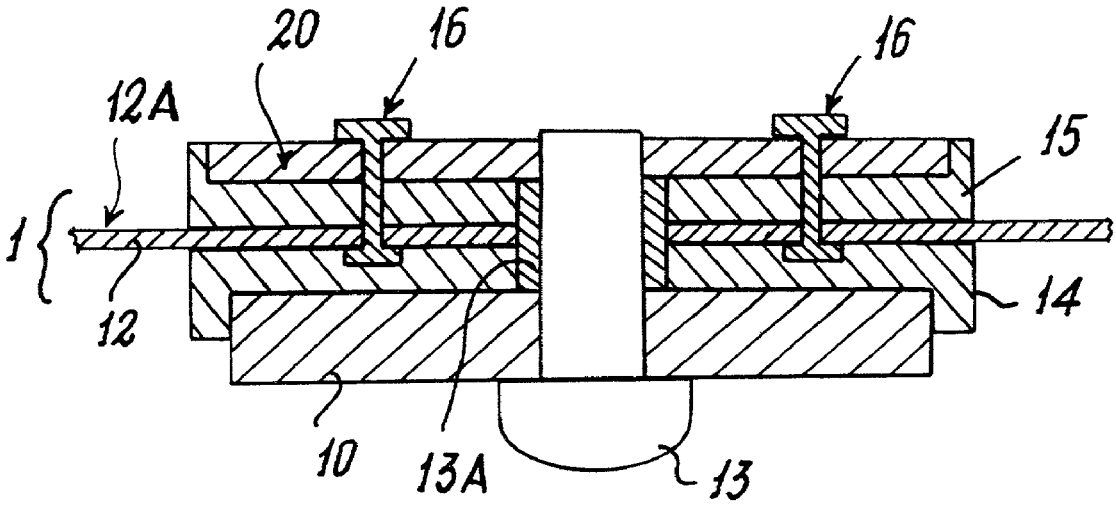
FIG. 2 is an enlarged section through that part of a hinge to be fixed to the cabinet or to a door of a refrigerator of FIG. 1.

With reference to said figures, a refrigerator comprises a cabinet 1 containing at least one food preservation compartment (not shown) provided with its own door 2. The door is connected to the cabinet 1 by hinges 3. In the example show in the figures, the hinge is of the double articulated parallelogram type; however it can also be more simple and be defined only by a single articulated parallelogram, or be more simply defined by a pin carried by a support fixed for example to the cabinet 1 and rotating in a seat in the door 2 (or in a part fixed to this latter).

Known members or user devices (not shown) are present on the door, such as a drink or ice dispenser, or control members for the refrigerator or for the user devices associated with it. These members or user devices are accessible to the user without having to open the door 2.

The said members or user devices are electrically powered. For this purpose, conductors 5 and 6 are provided within the door 2 and cabinet 1 respectively. The conductor 5 is connected to said user devices, while the conductor 6 is connected to an electricity source external to the refrigerator (for example the electricity mains of the room in which the appliance is located), with its voltage suitably transformed (reduced). The conductors 5 and 6 are preferably incorporated into the usual insulation material 7 of said door and cabinet.

Said conductors are connected together via the hinge 3, at least part of which is electrically conductive, for example of metal.

Specifically, the hinge 3 shown in FIG. 1 comprises two portions 3A and 3B movable relative to each other (in known manner) and each comprising a hinge fixing end 10. This fixing end or base 10 is fixed to the outer covering 12 of the cabinet 1 or door 2 by a plurality of screws 13. The screws are inserted through bushings 13A of insulating material disposed at least between the screw and the covering 12.

Each end 10 cooperates with a flat element 14 interposed between it and the corresponding outer covering 12; another flat element 15 is associated with the covering 12 on that side thereof which cooperates with the insulating material 7. This element 15 is fixed to the covering 12 by the screws 13 and, preferably, also plastic rivets 16 mounted before insulating the cabinet 1 or the door 2. In addition, a reinforcement element 20 is positioned on the said element 15.

The reinforcement element 20 is of metal and is in direct contact with every screw 13. Every flat element 14 and 15 is instead of insulating material. A corresponding conductor 5 or 6 is connected to the reinforcement element 20 or to at least a screw 13.

Consequently, each user device present on the door is electrically connected through the hinge 3. Specifically, this is achieved via the conductor 5, at least one screw 13 connecting the portion 3A of the hinge 3 to the cabinet 1, the portion 3A itself, the portion 3B of the hinge, at least one screw 13 connecting this latter to the door, and the conductor 6.

Said connection can be achieved through the hinge even if this is of different configuration, provided at least a part of it is electrically conductive.

The aforedescribed solution is of simple implementation and safe use, and also enables the mounting of the door on the cabinet 1 to be reversed. For this purpose it is sufficient to arrange respective conductors 6 already connected to reinforcement elements 20 for hinges scheduled for opposing sides of the cabinet (enabling right or left door mounting to be reversed); by fixing a corresponding hinge to each reinforcement element on that side of the cabinet chosen for connecting the door, each conductor 6 is connected to a corresponding conductor 5 present in the door 2.

The electrical connection to the hinge bases can be made, particularly in the case of cabinets and/or doors of polymer material, by elastic metal push-on connectors cooperating with the ends of screws which fix the hinge to the cabinet and/or door of the appliance.

We claim:

1. A refrigerator comprising:

a cabinet defining at least one food preservation compartment and having at least a first conductor configured to connect to a source of electricity;

a door for selectively closing the cabinet and having at least a second conductor configured to supply power to at least one user device provided on the door;

an electrical connection device coupling the first and second conductors and comprising a hinge connecting the cabinet to the door and the hinge comprising an electrically conductive first hinge plate and a first electrically conductive fastener mounting the first hinge plate to the cabinet and electrically coupled to the first conductor, an electrically conductive second hinge plate and a second electrically conductive fastener mounting the second hinge plate to the door and electrically coupled to the second conductor, wherein the first and second hinge plates are electrically coupled to define an electrically conductive path from the first conductor to the first hinge plate to the second hinge plate to the second conductor to supply power from the source of electricity to the user device; and first and second electrically conductive reinforcement elements, the first electrically conductive reinforcement element electrically coupled to the first electrically conductive fastener, and the second electrically conductive reinforcement element electrically coupled to the second electrically conductive fastener.

2. The refrigerator according to claim 1, wherein the first and second electrical fasteners pass through an outer panel of the cabinet and door, respectively, and into an interior of the cabinet and door, respectively, to mount the first and second hinge plates to the cabinet and the door, respectively.

3. The refrigerator according to claim 2, wherein the first and second conductors are located in the interior of the cabinet and the door, respectively.

4. The refrigerator according to claim 3, wherein the first and second electrically conductive fasteners are electrically insulated from the cabinet and door.

5. The refrigerator according to claim 4, and further comprising a first electrically insulating bushing positioned between the first electrically conductive fastener and the outer panel of the cabinet and a second electrically insulating bushing positioned between the second electrically conductive fastener and the outer panel of the door.

6. The refrigerator according to claim 5, and further comprising a first electrically insulating member positioned between the first hinge plate and the cabinet and a second electrically insulating member position between the second hinge plate and the door to electrically insulate the first and second hinge plates relative to the cabinet and the door.

7. The refrigerator according to claim 1, wherein the first and second reinforcement elements are electrically insulated from the cabinet and door, respectively.

8. The refrigerator according to claims 7, and further comprising a first electrically insulating member positioned between the first reinforcement element and the cabinet and a second electrically insulating member positioned between the second reinforcement element and the door.

9. The refrigerator according to claim 1, wherein the first and second conductors are embedded in insulating material of the cabinet and door, respectively.

10. The refrigerator according to claim 1, wherein the first and second hinge plates are electrically insulated from the cabinet and the door, respectively.

11. The refrigerator according to claim 1, and further comprising a hinge pin electrically connecting the first hinge plate and the second hinge plate.

* * * * *